US005219183A

United States Patent [19]

McKillip

[11] Patent Number: 5,219,183

[45] Date of Patent: Jun. 15, 1993

[54] PRINTABLE SHEET HAVING SEPARABLE CARD

[75] Inventor: Barron G. McKillip, Grand Rapids, Mich.

[73] Assignee: CCL Label, Inc., Grand Rapids, Mich.

[21] Appl. No.: 792,692

[22] Filed: Nov. 15, 1991

[51] Int. Cl.[5] ..... B42D 15/00

[52] U.S. Cl. ..... 283/62; 283/81; 283/101; 428/40; 428/43

[58] Field of Search ..... 283/81, 101, 95, 98, 283/103, 105, 62; 428/40-43; 40/299, 630

[56] References Cited

U.S. PATENT DOCUMENTS 3,854,229 12/1974 Morgan ..... 283/101 X
3,907,557 9/1975 Bolduc, Jr. .
4,544,181 10/1985 Maurer et al. .
4,661,189 4/1987 Voy et al. .
4,767,654 8/1988 Riggsbee ..... 283/101
4,799,712 1/1989 Biava et al. ..... 283/81 X
4,804,827 2/1989 Jung .
4,863,195 9/1989 Capozzola ..... 283/81 X
4,930,812 6/1990 Howard .
4,935,288 6/1990 Honaker et al. .
4,939,674 7/1990 Price et al. .
5,007,663 4/1991 Moran ..... 283/81

*Primary Examiner*—Mark Rosenbaum
*Assistant Examiner*—Willmon Fridie, Jr.
*Attorney, Agent, or Firm*—Warner, Norcross & Judd

[57] ABSTRACT

A printable sheet having one or more separable identification or the like is disclosed. A face sheet is overlyingly adhered to a backing sheet by a layer of pressure sensitive adhesive. The rear surface of the face sheet is pattern coated with a release agent only in regions disposed in registration with the cards to be formed as portions of the face sheet. A cut line is formed through the face sheet along the perimeters of the cards so that the cards may be readily peeled away leaving the remainder of the face sheet adhered to the backing sheet. The printable sheet may be imprinted on automated printing devices and is particularly suited for printing with a laser printer. Also disclosed is a method for making the printable sheet.

16 Claims, 1 Drawing Sheet

PRINTABLE SHEET HAVING SEPARABLE CARD

BACKGROUND OF THE INVENTION

1. Field of the Invention

The present invention relates to a printable sheet having a separable card and, more particularly, to a sheet including a face sheet overlyingly adhered to a backing sheet with cut portions of the face sheet being readily peelable from the backing sheet.

2. Description of the Related Art

It is frequently desired to provide written or printed matter in a form including a card, certificate, coupon, or the like. A common instance of this is a notice of automobile insurance coverage coupled with an identification card or certificate which is separated from the notice and kept with the insured vehicle. Usually, both the main body of the notice and the card will be imprinted with both constant and variable information. The constant information may include items such as the name and address of the insurance carrier, field headings, and lineations defining lines or columns in which the variable information is to be printed. The variable information may include items such as the policy number, the insured's name and address, the amount of coverage, etc. Some of the information will be printed on both the main body of the notice and on the separable card or certificate.

In the past, printable sheets with separable cards have been provided as a single sheet of paper having perforated tear lines which define the main body and the separable card or cards. Such sheets are usually printed in large volumes by computerized devices. Whatever device is used, it is important that the sheets be manufactured so they may be readily printed without tending to jam the printing equipment and that the cards may be readily separated from the main body without damage to the card or main body, or to the printed information thereon. The perforated tear lines used in the past necessarily form weak lines in the paper which may tend to fold or tear in the printing equipment.

More recently, it has become desirable to print business correspondence on laser printers due to the flexibility and high print quality afforded by such devices. However, laser printers require the paper stock to be uniform and strong in order to withstand the stresses imposed on the paper by the feeding mechanisms and pressure rollers, and to provide a uniformly smooth surface that will properly take up the toner. Because of these requirements, paper sheets having perforated tear lines are poorly suited for use in laser printers.

Furthermore, identification cards of convenient wallet size are too small to be fed individually through standard laser printers. Therefore, it is necessary to incorporate the card in a larger sheet which the printer can accommodate yet which will not cause jamming or other malfunctions.

Accordingly, there is an unmet need for a printable sheet usable with automated printing equipment such as laser printers yet which provides a card that is readily separable from the sheet without tearing or damage.

SUMMARY OF THE INVENTION

The present invention satisfies the aforementioned need by providing a printable sheet including one or more readily separable cards, certificates, or the like constructed as a lamination of a face sheet adheringly overlying a backing sheet. Adhesive material extends over substantially the entirety of the front surface of the backing sheet. A release agent is pattern coated on the rear surface of the face sheet only in one or more discrete regions in registration with selected portions of the face sheet which comprise the separable card or cards. Cuts are made through the face sheet at the perimeters of the cards. The release agent on the rear surface of the cards enables the cards to be peeled away cleanly from the backing sheet, leaving the remainder of the face sheet adhered to the backing sheet.

Even though the cards are readily separable from the printable sheet at the desired time, the sheet has sufficient strength, uniformity, and integrity that it is suitable for being imprinted with a laser printer. The adhesion between the card portions and the backing sheet, and between the remainder of the face sheet and the backing sheet, is sufficient to keep the sheet in flat, smooth, assembled relationship that will not cause interference or jamming while passing through the printer mechanisms.

The printable sheet may be provided in discrete, individual sheets, in fanfolded form, or in other forms. Also disclosed is a method for making the printable sheets of the invention.

These and other objects, advantages, and features of the present invention will be more fully understood and appreciated by reference to the written specification and appended drawing.

DESCRIPTION OF THE PREFERRED EMBODIMENT

Figure 1:
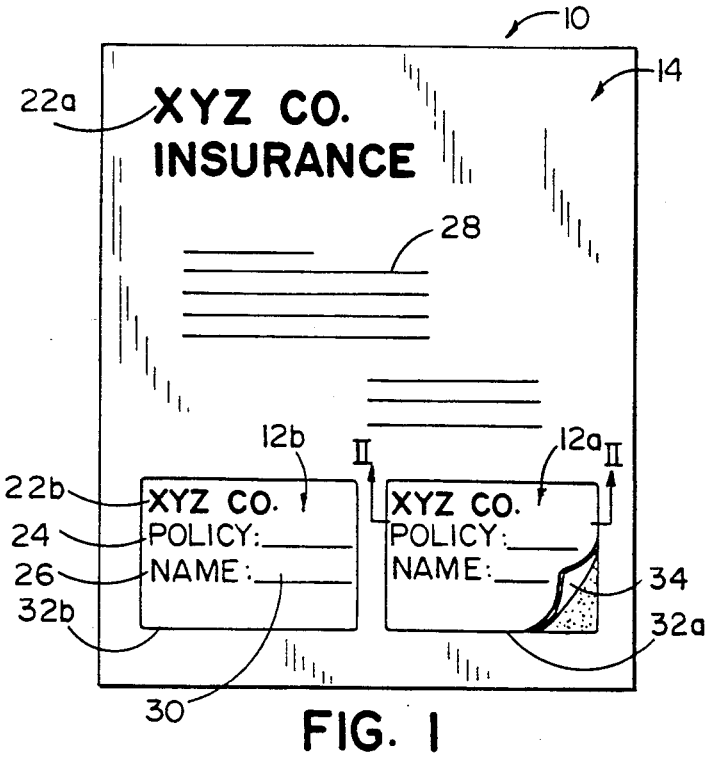
FIG. 1 is a front view of a printable sheet having separable cards according to the principles of the invention.

By way of disclosing a preferred embodiment, and not by way of limitation, there is shown in FIG. 1 a printable sheet 10 having two separable cards **12*a*, 12*b***. It is to be understood that the term "card" as used herein and in the appended claims is intended to include any document of convenient size and shape bearing imprinted information such an identification card, certificate of insurance, coupon, or the like. Furthermore, while the preferred embodiment of the printable sheet is provided with two such cards, it is to be understood that the invention may be practiced with the provision of only a single card, or more than two cards.

In the preferred embodiment, the sheet is of business letter size and the cards are of a convenient size for carrying in a wallet or glove compartment. However, other sizes are within the scope of the invention. The cards **12*a*, 12*b*** are depicted disposed inwardly from the perimeter of the sheet and spaced apart from each other. Other configurations are possible such as edges of the cards being flush with an edge or edges of the sheet or the cards being disposed in abutment with one another.

Figure 2:
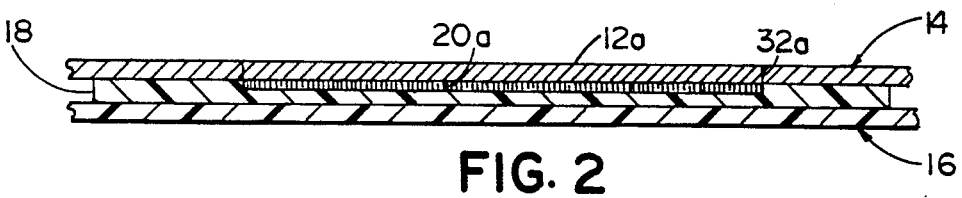
FIG. 2 is a sectional view, with thickness exaggerated, taken along the line 2—2 of FIG. 1.

In its general organization, as shown in FIGS. 1 and 2, the printable sheet 10 includes a face sheet 14, a backing sheet 16, a layer of pressure sensitive adhesive 18 disposed between the face sheet and the backing sheet, and a coating of release agent 20*a* disposed between the face sheet and the adhesive substantially only in regions in registration with the cards 12*a*, 12*b*. The front surface is imprinted with various indicia including nonvariable information such as a company name 22*a*, 22*b*, and field identifiers such as "Policy:" and "Name:" as at 24 and 26, and variable information such as name, address, policy number, coverage information as at 28 and 30.

The perimeters of the cards 12*a*, 12*b* are defined by generally rectangular cut lines 32*a*, 32*b*. The cut lines extend completely through the face sheet 14. Thus, discrete, separable regions of the face sheet form the cards.

Other types of cut lines may be employed, such as an intermittent or perforated cut line. A card may be peeled away from the printable sheet by lifting an edge or corner of the card as indicated at 34. Lifting of the card is continued until the card is removed from the sheet. Severance of the cards from the remainder of the face sheet along cut lines 32*a*, 32*b* enables the cards to be readily and cleanly separated without damage to the cards, the face sheet, or the printed indicia. The release agent coated on the back of the card prevents any of the adhesive from transferring to the card.

Figure 3:
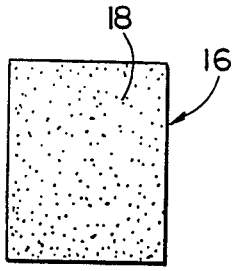
FIG. 3 is a front view, on a reduced scale, of the front surface of the backing sheet with a coating of adhesive applied prior to assembly with the face sheet.
Figure 4:
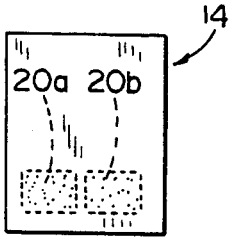
FIG. 4 is a rear view, on a reduced scale, of the rear surface of the face sheet with release agent applied prior to assembly to the backing sheet.

Further details of the printable sheet of the invention are shown in FIGS. 3 and 4. Prior to the assembly of the face sheet 14 to the backing sheet 16, the front surface of the backing sheet is coated with a pressure sensitive adhesive material over substantially the entirety the front surface, as shown in FIG. 3. Preferably, an adhesive material is used that will form a substantially permanent bond with uncoated portions of the face sheet. A general purpose hot melt adhesive such as Fasson 5246 adhesive has been found to be suitable, although other suitable alternatives will be well known to those skilled in the art.

As shown in FIG. 4, also prior to assembly of the face sheet 14 to the backing sheet 16, the rear surface of the face sheet is pattern coated with a release agent 20*a*, 20*b* in two substantially rectangular areas substantially coextensive with the cards 12*a*, 12*b* to be cut from the face sheet and later separated therefrom. To facilitate manufacture of the sheet, the areas of release agent 20*a*, 20*b* may be made slightly larger than the cards. The release agent reduces the degree of adhesion between the pressure sensitive adhesive 18 and the cards 12*a*, 12*b* so that the cards may be readily peeled off the backing sheet while the main body, or remainder, of the face sheet remains adhered to the backing sheet. As is well known in the art, a silicone material is preferably used as the release agent.

The material used for the face sheet 14 may be any of a wide variety of printable sheet materials, preferably paper. If it is desired to enhance the durability of the cards, then a reinforced material may be used. A suitable polypropylene reinforced paper stock is available from the Feron company of Germany under the trademark SERALIN.

After the front surface of the backing sheet 16 has been coated with adhesive 18 and the rear surface of the face sheet has been pattern coated with release agent, the rear surface of the face sheet is overlyingly adhered to the front surface of the backing sheet. Next, the cut lines 32*a*, 32*b* are formed, preferably by die cutting, in registration with the perimeters of the pattern coated areas 20*a*, 20*b*, thereby defining the separable cards 12*a*, 12*b*.

The printed indicia 22*a*, 22*b*, 24, 26, 28, 30 may be imprinted at any of several stages of the manufacture of the sheet 10. For example, the nonvariable indicia may be printed on the face sheet prior to the application of the release agent or after the sheet is completely assembled. Alternatively, the printing of both the variable and nonvariable indicia may be accomplished by means of a laser printer after the sheet is completely assembled.

Figure 5:
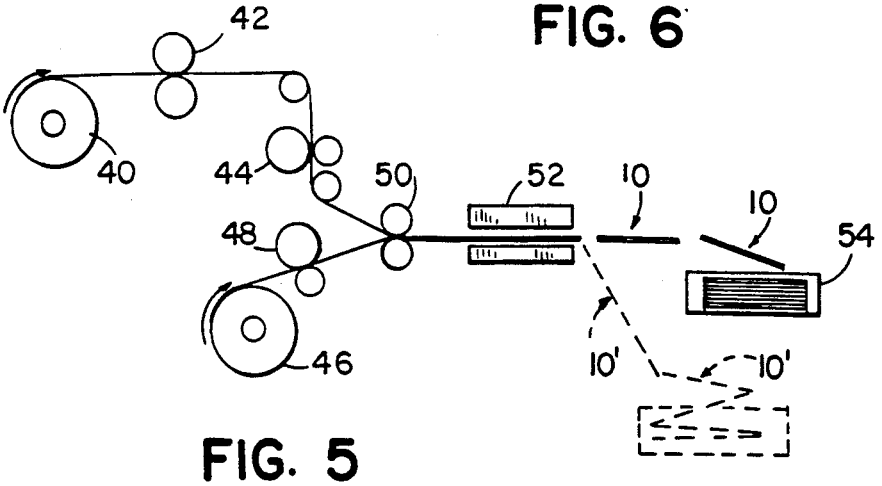
FIG. 5 is a diagrammatic view illustrating an apparatus and method for making the printable sheets of the invention.

A preferred method for mass production of the printable sheets of the invention is illustrated diagrammatically in FIG. 5. A roll of a continuous web of face sheet stock 40 is uncoiled and directed through a printing device 42 which repetitively imprints nonvariable indicia at intervals on the front surface of the face sheet stock. Thereafter, the web of face sheet stock advances to a pattern coating device 44, such as a silk screen printer, which coats release agent on to the rear surface of the face sheet stock only in the discrete regions from which the separable cards will be formed.

A roll of a continuous web of backing sheet stock 46 is uncoiled beneath the face sheet stock. A coating of pressure sensitive adhesive is applied continuously to the backing sheet stock by applicator roller 48. The advancing webs of backing sheet and face sheet converge and are pressed together by pressure roll 50, thereby overlyingly adhering the face sheet stock to the backing sheet stock.

The adhered together webs further advance from the pressure roll 50 to die cutter 52. The die cutter 52 acts in registration with the pattern release agent coated regions of the face sheet to cut the lines 32*a*, 32*b* and thereby form the cards 12*a*, 12*b*. The die cutter also transversely severs the adhered face and backing sheet webs so as to form individual printable sheets 10 which are collected in a bin 54. Alternatively, the die cutter may form partial cuts or perforated lines across the adhered webs so as to form fanfolded, separable sheets 10' indicated in broken lines.

Figure 6:
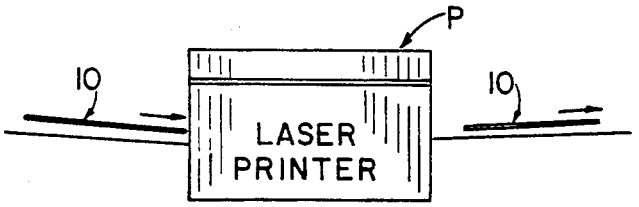
FIG. 6 is a diagrammatic view illustrating the imprinting of indicia on the printable sheets with a laser printer.

Thereafter, as shown in FIG. 6, the printable sheets 10 or 10' are fed through a printing device, such as a laser printer P, for the imprinting of additional information.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

I claim:

1. A printable sheet having a separable card comprising:

a backing sheet having a front surface;

a face sheet having a front surface and a rear surface, said face sheet having a cut line therethrough, said cut line defining the perimeter of a portion of said face sheet, said portion of said face sheet comprising said separable card;

a release agent coating disposed substantially only over a discrete region of said face sheet rear surface in registration with said separable card; and an adhesive material disposed between said face sheet rear surface and said backing sheet front surface adhering said face sheet and said backing sheet together in overlying relationship;

whereby said separable card may be peeled away from said backing sheet leaving the remainder of said face sheet adhered to said backing sheet.

2. The printable sheet according to claim 1 further comprising indicia printed on said separable card.

3. The printable sheet according to claim 1 further comprising a plurality of said cut liens through said face sheet, said cut lines defining the perimeters of a plurality of portions of said face sheet, said plurality of portions comprising a plurality of said separable cards.

4. The printable sheet according to claim 3 further comprising a plurality of cut lines formed through said face sheet, each of said cut lines disposed along the perimeter of one of said separable cards.

5. The printable sheet of claim 1 further comprising indicia printed on said face sheet.

6. A printable sheet having at least one separable card comprising:

a backing sheet having a front surface;

a face sheet having a rear surface and a front surface, said rear surface disposed overlying said backing sheet, said face sheet having a cut line therethrough, said cut line defining the perimeter of a portion said face sheet, said portion comprising said at least one separable card;

a layer of adhesive material disposed between said backing sheet and said face sheet and adhering the front surface of said backing sheet to the rear surface of said face sheet in overlying relationship;

a coating of a release agent substantially only on a discrete region of said rear surface of said face sheet, said discrete region disposed in registration with said at least one separable card, said coating disposed between said face sheet and said adhesive material;

said cut line allowing the at least one separable card to peeled away leaving the remainder of said printable sheet adhered to said backing sheet;

whereby said face sheet may be imprinted in a printing device prior to separation of said at least one card.

7. The printable sheet of claim 6 further comprising a plurality of said separable cards, each said separable card formed as a portion of said face sheet, said coating of a release agent disposed in a plurality of discrete regions each in registration with one of said separable cards.

8. The printable sheet of claim 7 wherein said separable cards are disposed inwardly from the perimeter of said printable sheet.

9. The printable sheet of claim 6 further comprising indicia imprinted on the front surface of said face sheet.

10. The printable sheet of claim 9 wherein said indicia is imprinted by a laser printer.

11. The printable sheet of 6 wherein the rear surface of said separable card is free of adhesive after separation.

12. A method for making a printable sheet having at least one separable card comprising the steps of:

providing a backing sheet having a front surface;

coating an adhesive material on said front surface of said backing sheet;

providing a face sheet having a front surface and a rear surface;

coating a release agent onto the rear surface of said face sheet only in at least one discrete region of said rear surface;

overlyingly adhering said face sheet rear surface to said backing sheet front surface;

forming at least one cut line in said face sheet in registration with said discrete region whereby said discrete region forms said separable card.

13. The method of claim 12 further comprising the step of imprinting indicia on said front surface of said face sheet.

14. The method of claim 13 wherein said step of imprinting is performed after said step of forming a cut line.

15. The method of claim 14 wherein said step of imprinting further comprises imprinting with a laser printer.

16. The method of claim 12 wherein said step of coating includes coating a release agent in a plurality of discrete regions of said rear surface, and wherein step of forming at least one cut line includes forming cut lines in registration with said plurality of discrete regions thereby to form a plurality of said separable cards.

* * * * *

UNITED STATES PATENT AND TRADEMARK OFFICE

CERTIFICATE OF CORRECTION

PATENT NO. : 5,219,183

DATED : June 15, 1993

INVENTOR(S) : Barron G. McKillip

It is certified that error appears in the above-identified patent and that said Letters Patent is hereby corrected as shown below:

In the Abstract, lines 1 and 2:
after "identification" insert --cards--

Column 5, claim 3, line 11:
"liens" should be --lines--

Signed and Sealed this

Eleventh Day of January, 1994

Bruce Lehman

*Attest:*

BRUCE LEHMAN

*Attesting Officer*

*Commissioner of Patents and Trademarks*